US006621255B2

(12) United States Patent
Telefus

(10) Patent No.: US 6,621,255 B2
(45) **Date of Patent: *Sep. 16, 2003**

(54) LINEAR AC TO DC REGULATOR WITH SYNCHRONOUS RECTIFICATION

(75) Inventor: Mark D. Telefus, Orinda, CA (US)

(73) Assignee: iWatt, Inc., Campbell, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/051,760

(22) Filed: Jan. 15, 2002

(65) Prior Publication Data

US 2002/0130644 A1 Sep. 19, 2002

Related U.S. Application Data

(63) Continuation of application No. 09/627,953, filed on Jul. 28, 2000, now Pat. No. 6,404,173.

(51) Int. Cl.[7] ..... G05F 1/40

(52) U.S. Cl. ..... 323/272; 323/282

(58) Field of Search ..... 323/220, 223, 323/226, 268, 270–273, 282

(56) References Cited

U.S. PATENT DOCUMENTS

| | | | | | |
|---|---|---|---|---|---|
| 4,159,428 | A | * | 6/1979 | Antonov et al. | 307/32 |
| 4,207,478 | A | * | 6/1980 | Marumoto et al. | 307/240 |
| 5,420,495 | A | * | 5/1995 | Hingorani | 323/218 |
| 5,585,994 | A | * | 12/1996 | Tamai et al. | 361/98 |
| 5,969,514 | A | * | 10/1999 | Rerrill | 323/283 |
| 6,034,514 | A | * | 3/2000 | Sakai | 323/225 |
| 6,172,493 | B1 | * | 1/2001 | Grant | 323/288 |
| 6,198,259 | B1 | * | 3/2001 | Ueki et al. | 323/224 |
| 6,275,014 | B1 | * | 8/2001 | Sudo | 323/222 |

* cited by examiner

*Primary Examiner*—Matthew V. Nguyen
(74) *Attorney, Agent, or Firm*—Bingham McCutchen LLP

(57) ABSTRACT

A power supply having a plurality of switches coupled in parallel between an input and an output regulates the output voltage by altering the number of conducting switches in response to power demands at the output.

8 Claims, 6 Drawing Sheets

LINEAR AC TO DC REGULATOR WITH SYNCHRONOUS RECTIFICATION

This patent application is a continuation of co-pending application U.S. Ser. No. 09/627,953, filed on Jul. 28, 2000, now U.S. Pat. No. 6,404,173.

FIELD OF THE INVENTION

This invention pertains generally to the field of power regulation and more particularly to a power regulator having discrete states of regulation.

BACKGROUND

As electronics become more sophisticated, the demands on power regulators have increased. For example, modern microprocessors need power supplies providing lower voltages at higher currents. Whereas in the past, a microprocessor might need a regulated power supply providing a maximum of 15 amps at 3.2 volts, a modern microprocessor may require a regulated power supply of 100 amps at 1.8 volts. Such a microprocessor would draw little current if in a dormant mode but would demand up to 100 amps of current during moments of heavy load. Given the high speed of these devices, the transition between low and high power demand may occur vary rapidly.

Linear regulators have been used to provide regulated power to microprocessors. A typical linear regulator is illustrated in FIG. 1. A differential amplifier, U1, compares the output voltage, V_out, to a reference voltage, V_ref, and adjusts the current drive to the base of the pass transistor, Q1, to make V_out track V_ref as the load current and input voltage, V_in, vary. If such a linear power regulator is used to regulate the power supply for a modern microprocessor, its slew rate will not accommodate the rapid transition between low and high current demands. Moreover, linear regulators are inefficient and tend to have high maintenance needs.

Avoiding the inefficiencies of a linear regulator, U.S. Pat. No. 5,969,514 discloses, as illustrated in FIG. 2, a plurality of power field effect transistors (FETs) M1–M8 arranged in parallel between an input voltage, $V_{in}$, and a load 13. A control circuit 20 maintains the FETs M1–M8 either in cutoff (OFF) or in saturation mode (ON). The control circuit 20 switches M1–M8 ON or OFF according to a digital feedback signal proportional to a voltage, $V_{OUT}$, on the load 13 as measured by an analog-to-digital converter 5. The control circuit 20 compares the digital feedback signal to a reference signal, $V_{REF}$, and switches ON or OFF a varying number of the FETs M1–M8 During moments of little power demand by the load 13, only a relatively small number of the FETs are ON. However, during moments of maximum power demand, all the FETs are ON. Because the saturation resistance of identically produced FETs tends to be quite similar, the FETs M1–M8 may be modeled as eight resistances R arranged in parallel, where R is the saturation resistance. If only one FET is ON, the resistance between the input and output is R. If all the FETs M1–M8 are ON, the resistance is R/8. In general, if N of the FETs are ON, the resistance is R/N. In this manner, the control circuit 20 determines a resistance between the input and output, where the resistance takes on discrete values as given by the number of conducting FETs.

Although the power supply of FIG. 2 efficiently keeps the FETs either in cutoff or saturation mode, it suffers from a number of disadvantages. For example, consider the case of an input voltage, $V_{in}$, having both positive and negative (AC) values. Because the source of power FETs is typically coupled to both the input voltage and the substrate, the FET, when ON, acts as a diode whose cathode is the drain and anode is the source. The resulting effective diode from the drain to the source will conduct, even though the FET is OFF, if the source is sufficiently lower in voltage than the drain. Such a scenario is possible in the case of an alternating voltage input, preventing power FETs from being switches and preventing the power supply of FIG. 2 from using an AC input voltage.

Thus, there is a need in the art for improved power regulators that maintain high efficiencies over a broad range of load conditions with AC voltage inputs.

SUMMARY OF THE INVENTION

The invention provides in one aspect a power regulator having a plurality of switches connected in parallel between an input and an output. A controller regulates an output voltage by switching ON a subset of the plurality of switches while maintaining the remainder of the plurality OFF. The controller switches ON or OFF the subset in response to comparing the output voltage and/or an output current to a threshold level. In addition, the controller may also provide synchronous rectification at the output by switching ON the subset only when an input voltage exceeds the output voltage.

Other aspects and advantages of the present invention are disclosed by the following description and figures.

DESCRIPTION OF FIGURES

The various aspects and features of the present invention may be better understood by examining the following figures.

DETAILED DESCRIPTION

Figure 3:
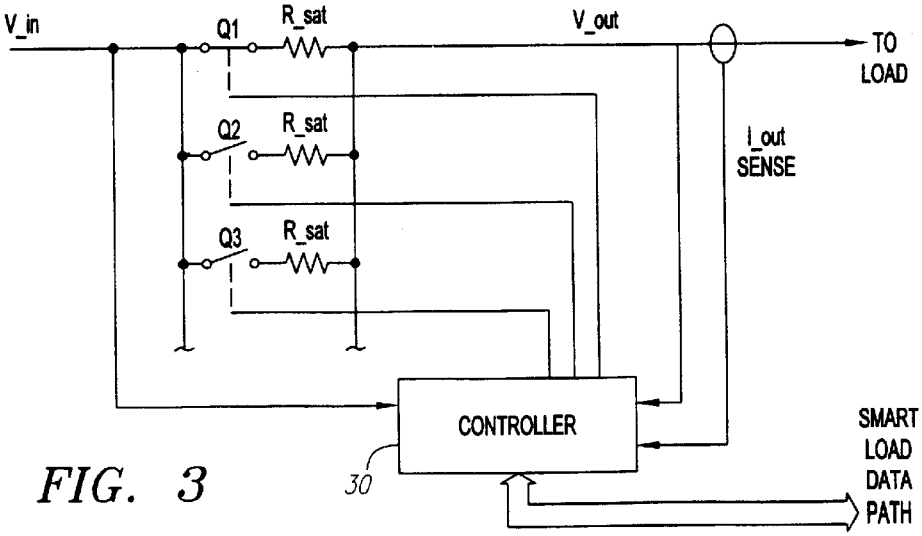
FIG. 3 illustrates a power regulator according to one embodiment of the invention.

Turning now to the figures, a power regulator 25 having a plurality of switches Q1, Q2, Q3, and so on arranged in parallel between an input voltage, V_in, and an output voltage, V_out, is illustrated in FIG. 3. A controller 30 switches a subset of the plurality of switches ON while maintaining the remaining switches in the plurality OFF in response to sensing a power demand from a load coupled to V_out. The power demand from the load will affect V_out and the output current, I_out, from the power regulator 5. As the power demand increases, V_out will tend to decrease as I_out increases. The controller 30 may compare V_out to a reference voltage and/or compare I_out to a reference current to determine the number of switches that need to be switched ON to maintain a constant voltage at the load coupled to V_out.

As will be explained further with respect to FIGS. 4*a* and 4*b,* each switch comprises FETs such that when ON, the switch may be modeled by a saturation resistance, R_sat. Because the switches are in parallel, their net resistance is then given by R_sat/N, where N is the number of switches that are ON. switches that are OFF have such a higher resistance value that they may be ignored in estimating the net resistance of the switches. Each switch may be constructed to advantageously carry a certain level of current. In turn, the controller 30 may use the desired current level to switch ON or OFF the switches. For example, consider the case of having switches that are designed to carry 1 amp of current. In embodiments of the invention in which the controller 30 senses I_out, the controller could use the desired switch current as the reference current value, in this case one amp. Should I_out be three amps, the controller 30 would switch ON three switches and so on such that if I_out is N amps there would be N switches switched ON.

Figure 1:
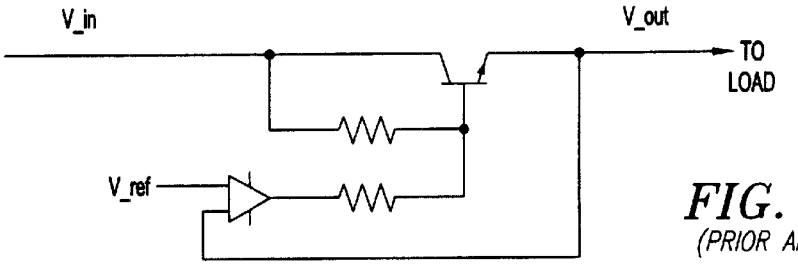
FIG. 1 (PRIOR ART)
FIG. 1 illustrates a prior art linear regulator.
Figure 2:
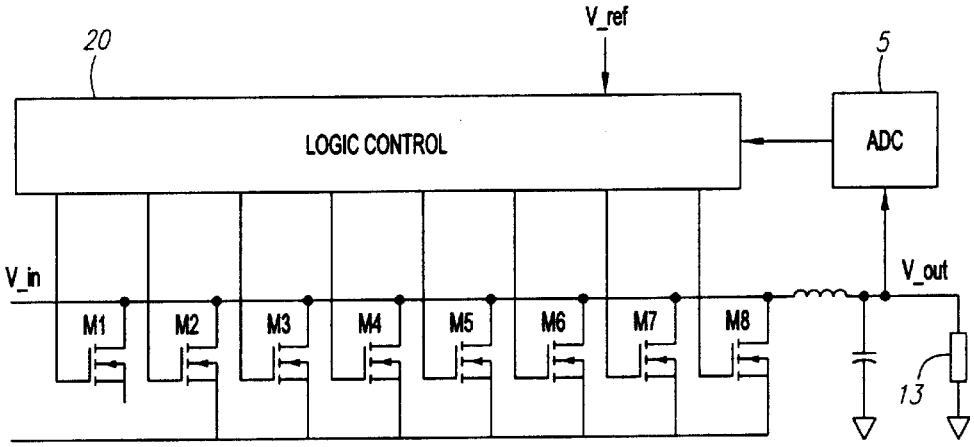
FIG. 2 (PRIOR ART)
FIG. 2 illustrates a prior art power regulator having a plurality of transistors coupled in parallel between an input and an output.
Figure 4A:
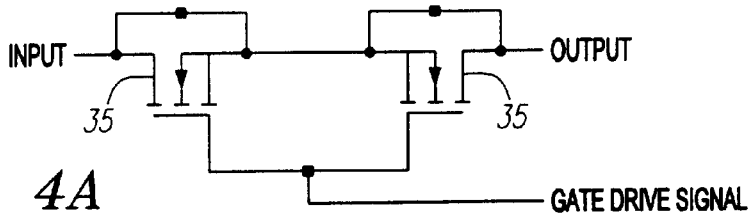
FIGS. 4*a* and 4*b* illustrate specific switches suitable for implementation with the present invention.

FIG. 4*a* illustrates one suitable embodiment of a switch comprised of two series-connected power FETs 35, wherein the series connection is source-to-source. Because a power FET has its substrate electrically connected to the source, it will effectively form a diode having its cathode at the drain and anode at the source, i.e., the diode points from the drain to the source. Since the sources are coupled, the "diodes" thus formed will point in opposing directions. Because the diodes are opposed, current cannot flow through the FETs 35 when the FETs 35 are OFF. In contrast, the switch formed by a single FET as discussed with respect to FIG. 2 would conduct current even if OFF, assuming the voltages are such as to forward bias the diode. The controller 30 provides a gate drive signal to the gates of the FETs 35 to switch them both ON or OFF. The bifurcation of the gate drive signal to each FET 35 from the controller 30 resembles, if viewed with the proper imaginations a slide to a trombone. Hence the embodiment of the switch formed by the FETs 35 in FIG. 4*a* may be denoted a "trombone" configuration.

Figure 4B:
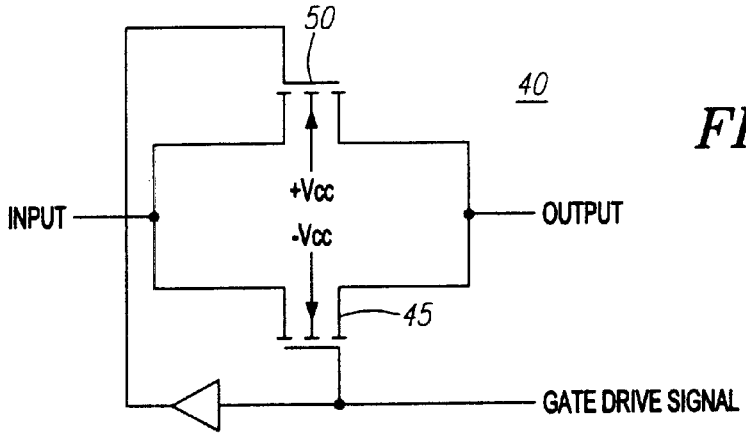

An alternate embodiment of a switch is illustrated in FIG. 4*b*. This configuration of FETs is conventionally referred to a transmission gate 40. The transmission gate 40 has an N-channel FET 45 coupled in parallel to a P-channel FET 50. Unlike the power FETs 35 illustrated in FIG. 4*a,* the FETs 45 and 50 used in the transmission gate 40 must have a fourth terminal allowing access to the substrate such that a −Vcc voltage may bias substrate of the N-channel FET 45 and a +Vcc voltage may bias the substrate of the P-channel FET 50. Just as with the "trombone" configuration of FIG. 4*a,* the transmission gate 40 will not allow current to flow between the input and output when the gate drive signal is "OFF." In both configurations, when ON, the switches may be modeled by the saturation resistance of the FETs. In the trombone configuration, the FETs are in series so that the net resistance of the trombone is twice the saturation resistance of the FETs. In the transmission gate, because only one FET conducts at a time, the net resistance of the transmission gate is equal to the saturation resistance of the FET that is conducting. It will be appreciated that embodiments of a switch other than the trombone and transmission gate may be used and are within the scope of the invention. Thus, as used herein "switch" refers to a switch that will not conduct when OFF and will conduct when ON, regardless of the relative polarities of the input and output.

The controller 30 may be constructed using either analog or digital circuitry. For example, a more sophisticated controller may be derived from classic control theory, optimal control theory, fuzzy logic, or some combination of these approaches including heuristics. The controller can be tailored to provide the performance characteristics that are important for an intended application of the power converter. These performance characteristics are many and meeting specific application requirements usually requires engineering tradeoffs among them. They include, but are not limited to: ripple amplitude, ripple spectrum, control loop stability, output voltage regulation, slew rate, thermal stress, and electromagnetic interference (EMI). In particular, the controller 30 may incorporate a microprocessor to perform these customized control applications. Should the load 13 itself be a microprocessor, the digital control functions of the controller could be implemented in this as well. Moreover, having a microprocessor as the load 13 leads to certain advanced control functionalities wherein the controller 13 anticipates rather than reacts to a change in power demands. For example, a microprocessor may signal when it is about to go from an inactive to an active state. The controller 30 would respond to this signal by increasing the number of switches that are ON such that these switches are conducting already as the microprocessor demands more current. Such an implementation or control functionality reduces the amount of voltage dropout as the microprocessor transitions into an active state.

Figure 5A:
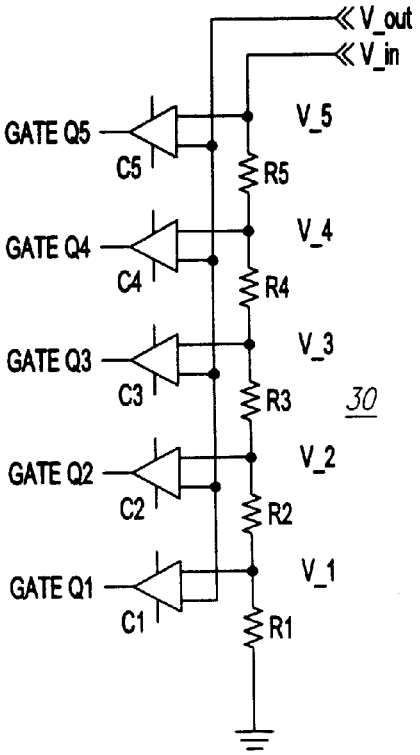
FIG. 5*a* illustrates an analog controller for regulating a DC output using a DC input according to one embodiment of the invention.

In an analog implementation, the controller 30 may comprise a ladder network as illustrated in FIG. 5*a*. In such an embodiment, the controller 30 compares V_out to a DC reference voltage, V_ref, and switches ON on the appropriate subset of switches accordingly. In FIG. 5*a,* the plurality of switches comprises Q1–Q5. Corresponding to each switch, a voltage divider formed from resistors R1–R5 generates a set of voltages V1–V5 from the reference voltage, V_ref. Using a reference voltage of 2.0 volts, Table 1 gives the set of voltages generated by the resistance values listed for R1–R5. A set of comparators C1–C5 couple to the set of voltages V1–V5, respectively. Each comparator compares V_out to its respective voltage from the set of voltages V1–V5. For example, the comparator C1 compares V_out to V_1 and so on. In general, the nth comparator Cn will subtract V_out from V_n. If this quantity is negative, the nth comparator switches ON the nth switch Qn. Conversely, if this quantity is positive, the nth comparator switches OFF the nth switch. In this fashion, the relationship between the number of ON switches and V_out will be as shown in Table 2. As can be seen, if V_out is less than 1.8 volts, all five switches Q1–Q5 are switched ON. As V_out rises, Q1 and so on will be switched OFF according to their respective thresholds as determined by the voltages V1–V5. Thus, the net resistance of the switches will be altered in discrete steps to regulate V_out. It will be appreciated that the polarity at the inputs of the comparators is arbitrary—i.e., rather than subtracting V_out from its reference voltage, each comparator could have subtracted its reference voltage from V_out. In such a case, the comparator would switch ON its respective switch if this quantity were positive. Conversely, the comparator would switch OFF its respective switch if this quantity were negative.

TABLE 1

| Rsat = 0.1<br>Vref = 2.0 | | |
|---|---|---|
| | Ladder | V_n |
| R5 | 850.0 | 2.00 |
| R4 | 50.0 | 1.83 |
| R3 | 50.0 | 1.82 |
| R2 | 50.0 | 1.81 |
| R1 | 9000.0 | 1.80 |
| Rtotal | 10000.0 | |

TABLE 2

| V_out | | Q | Q | Q | Q | Q | ttl |
|---|---|---|---|---|---|---|---|
| min | max | 1 | 2 | 3 | 4 | 5 | ON |
| 1.83 | 2.00 | 0 | 0 | 0 | 0 | 1 | 1 |
| 1.82 | 1.83 | 0 | 0 | 0 | 1 | 1 | 2 |
| 1.81 | 1.82 | 0 | 0 | 1 | 1 | 1 | 3 |
| 1.80 | 1.81 | 0 | 1 | 1 | 1 | 1 | 4 |
| 1.79 | 1.79 | 1 | 1 | 1 | 1 | 1 | 5 |

As microprocessors demand power supplies with lower voltages, the use of an AC "rail" to distribute power becomes increasingly important. The AC—AC controller 30 of FIG. 5*c* may be used to pre-regulate the voltage on the AC rail. At load points, the power carried by the AC rail could then be AC to DC converted for consumption by the microprocessor. Alternatively, the AC—AC controller 30 of FIG. 5*c* may be used in power faction correction applications. The AC—AC controller 30 FIG. 5*c* regulates an AC output voltage, V_out, according to an AC reference voltage, V_ref. Referring back to FIG. 5*a,* note that its ladder of comparators will respond correctly only to a DC reference voltage. For such a reference voltage, a switch should be ON to increase V_out if V_out is less than the threshold voltage at the comparator. But this scheme would not as an AC V_ref transitions from a positive to a negative polarity, wherein a given switch should be ON to decrease V_out if V_out is greater the negative reference voltage at the comparator. In this case, a comparator should subtract V_out from V_ref and switch ON its switch if the resulting quantity is positive. This scheme is exactly the opposite of what is desired if V_ref is positive, as already discussed with respect to FIG. 5*a.* Thus, the controller 30 of FIG. 5*c* has two ladders of comparators: a set 50 of comparators if V_ref is positive and a set 55 of comparators if V_ref is negative. A polarity comparator 60 determines what the polarity of V_ref is. The polarity comparator 60 controls a set of switches S1–S5 that couple the respective gates of the switches Q1–Q5 to the comparator in the appropriate set 50, 55, depending upon the polarity of V_ref. The switching times of the switches Q1–Q5 should be negligible as compared to the period of the oscillation frequency for V_ref. With such a relationship between the oscillation of V_ref and the switching times, the switches Q1–Q5 can switch ON or OFF as if V_ref were a DC voltage. In other words, the switches must be able to turn ON and OFF very quickly with respect to the changing levels of V_ref.

Figure 5B:
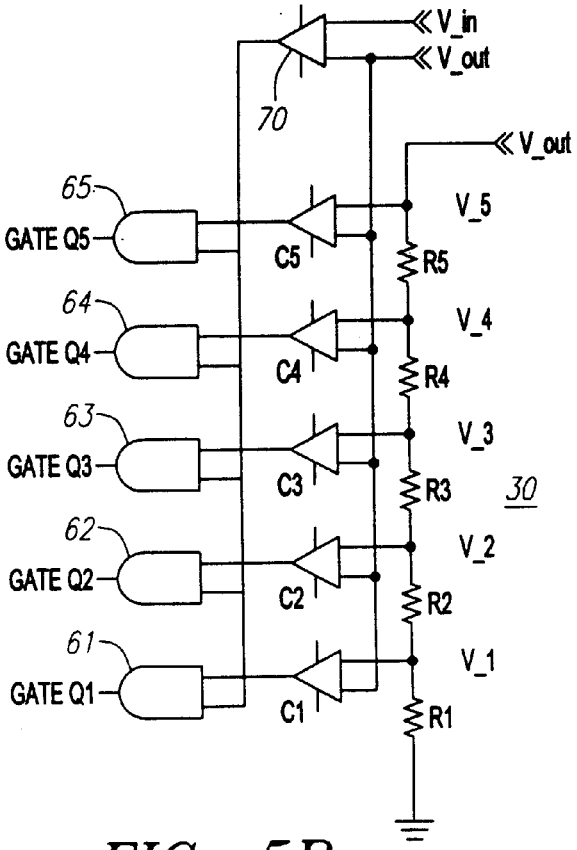
FIG. 5*b* illustrates an analog controller for regulating a DC output using an AC input, wherein the DC output is synchronously rectified according to one embodiment of the invention.
Figure 5C:
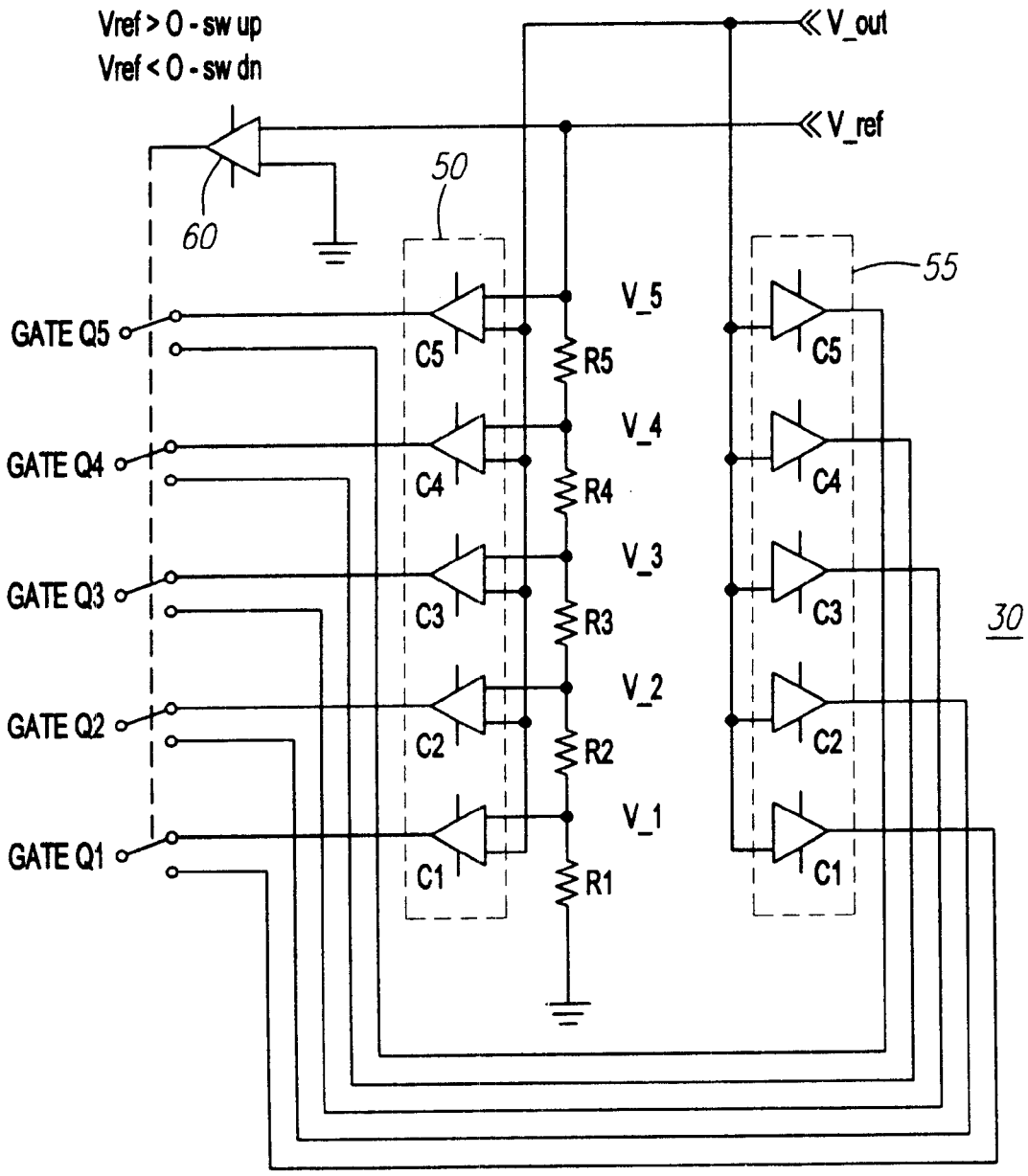
FIG. 5*c* illustrates an analog controller for regulating an AC output using an AC input according to one embodiment of the invention.

The power regulator 25 illustrated in FIG. 3 may also regulate a DC output voltage, V_out, with respect to an AC input voltage. In this embodiment of the invention, the controller 30 provides synchronous rectification as shown in FIG. 5*b.* The ladder of comparators C1–C5 and resistors R1–R5 are arranged as discussed with respect to FIG. 5*a.* However, the output of the comparators are not directly coupled to their respective switch gates. Instead, each comparator C1–C5 is coupled to an AND gate 61–65, respectively. In turn, the other input of each AND gate 61–65 couples to an input comparator 70 that determines whether the input voltage is greater than the output voltage. For example, a given switch only switched ON if its comparator detects that the output voltage is below its reference voltage and if the input comparator 70 determines that the input voltage is greater than the output voltage. Without the input comparator 70, because the input voltage is AC, a switch could be switched ON while the input voltage is less than the output voltage. This would lead to an undesirable drain of current from the load to the input.

Although synchronous rectification performed by the controller 30 of FIG. 5*b* is active only during the positive half cycles of the input voltage to produce a regulated output voltage having a positive polarity, this embodiment is easily altered to use only the negative half cycles of the input voltage to produce a regulated DC output voltage having a negative polarity. In such an embodiment (not illustrated), the input comparator 70 tests if the input voltage is less than the output voltage. In addition, the comparators C1–C5 would be arranged as discussed with respect to set 55 in FIG. 5*c.* Thus, a given switch would be ON only if the input voltage was less than the output voltage and the output voltage was greater than the reference voltage at the respective comparator.

Figure 6:
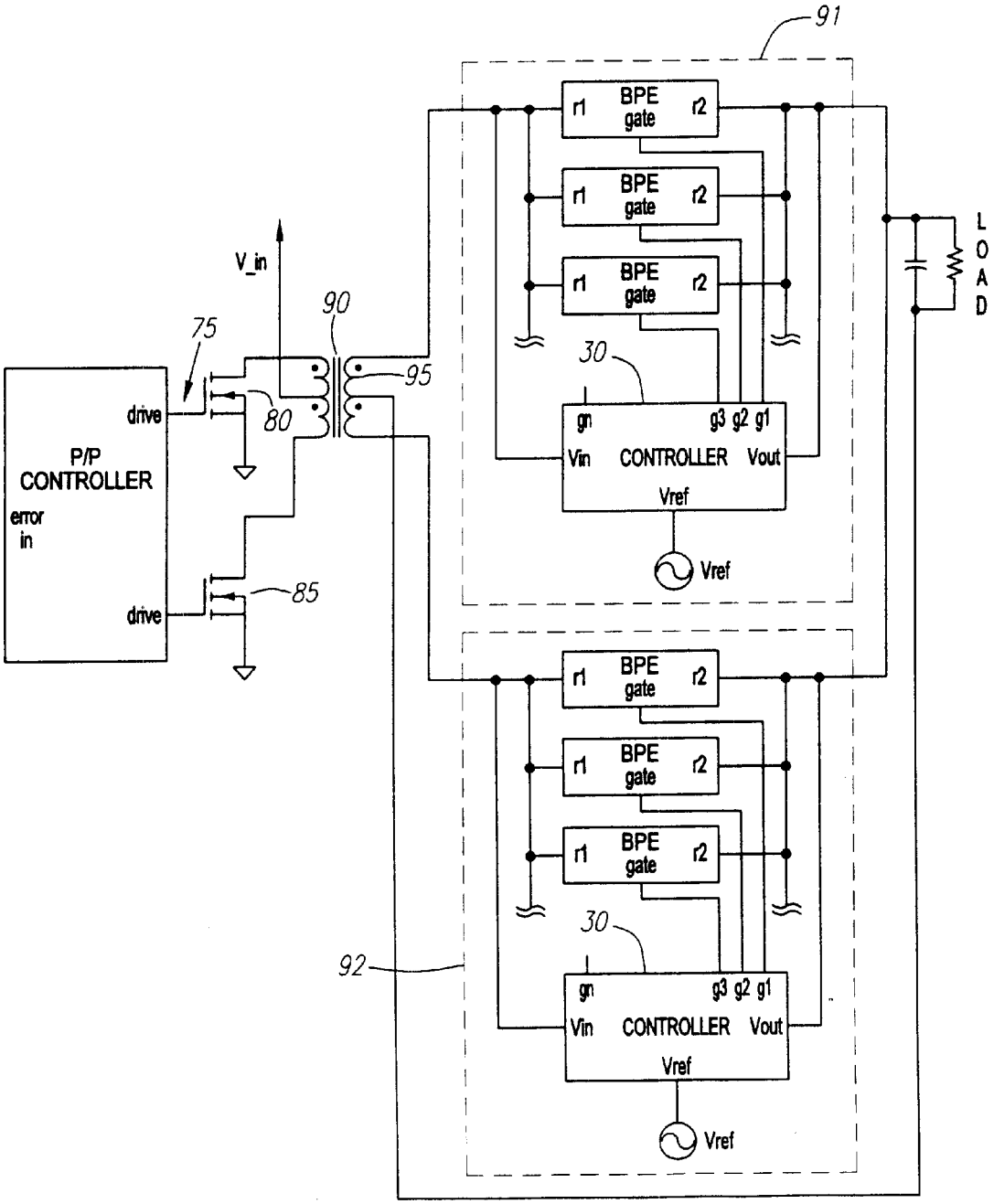
FIG. 6 illustrates a power supply performing full wave synchronous rectification according to one embodiment of the invention.
Figure 7:
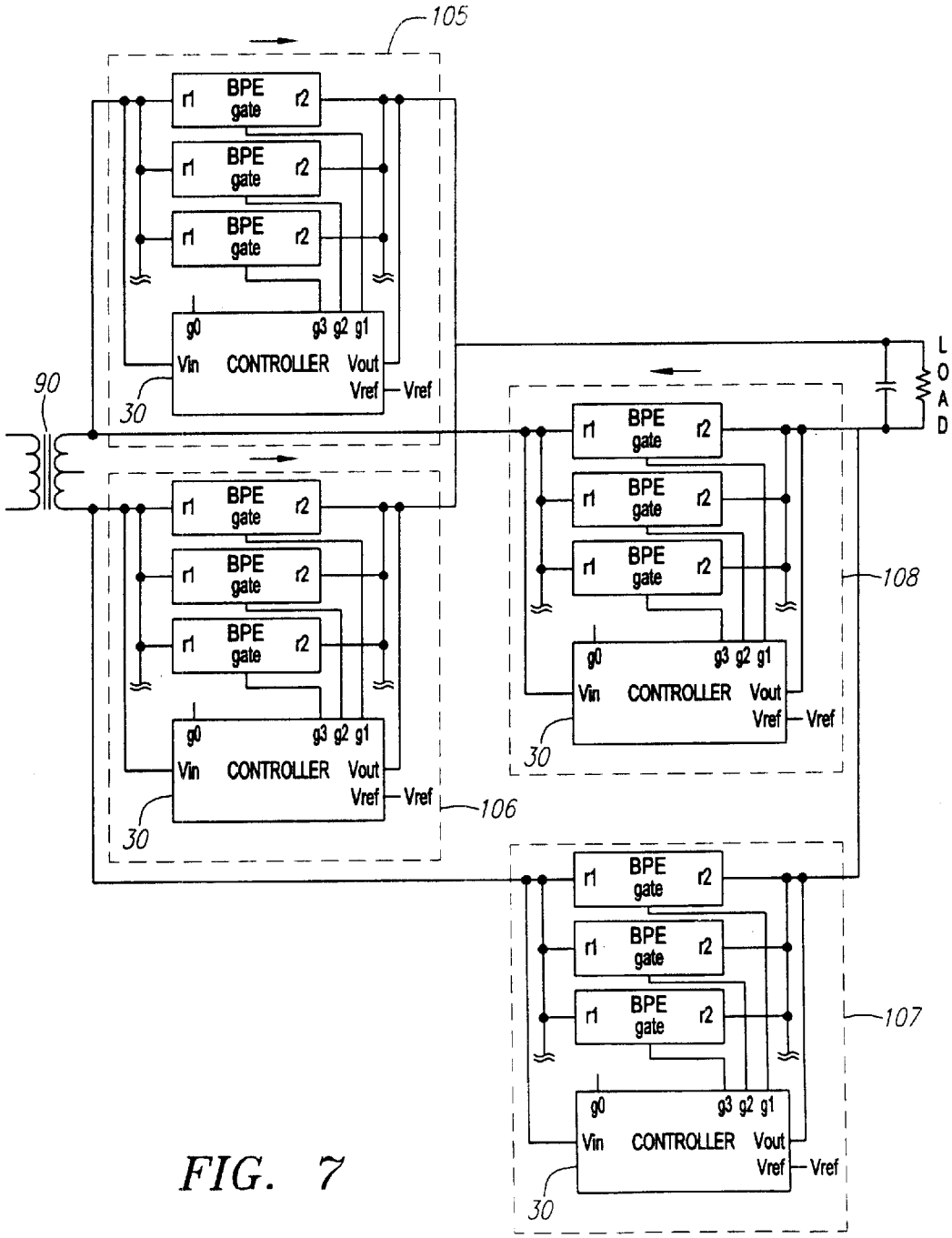
FIG. 7 illustrates a power supply performing full wave synchronous rectification according to one embodiment of the invention.
Figure 8:
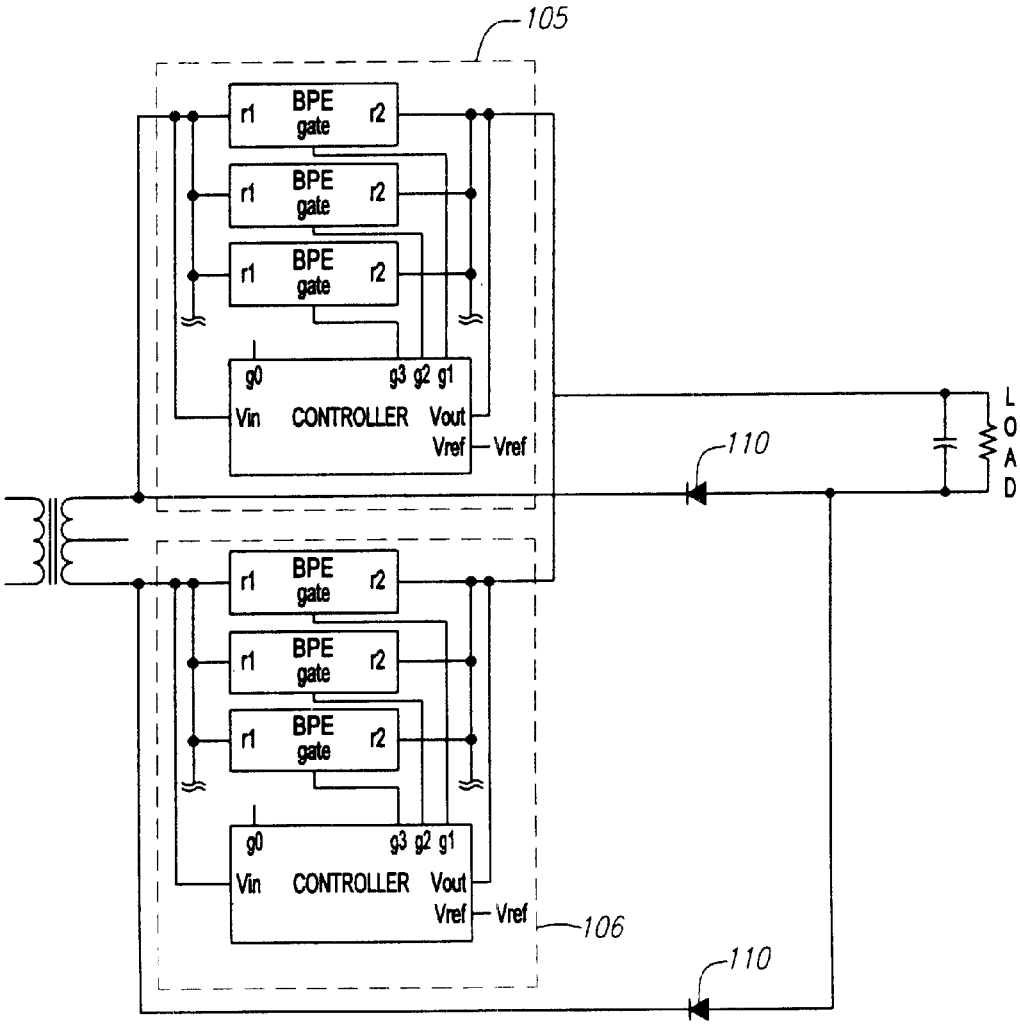
FIG. 8 illustrates a power supply performing full wave synchronous rectification according to one embodiment of the invention.

In addition to the half-wave synchronous rectification just discussed, the present invention may perform full-wave synchronous rectification as illustrated in FIG. 6. In this embodiment, a push-pull converter 75 alternately switches FETs 80 and 85 to drive an alternating current through the primary winding of a center tapped transformer 90. Two sets 91 and 92 of parallel switches (denoted as pass elements (BPE)) 30 are coupled antipodally with respect to the center tap of the secondary 95 and a load. Each set 91 and 92 is controlled by a controller 30 that performs synchronous rectification as discussed with respect to FIG. 5*b.* Because the sets of switches 91 and 92 are antipodally coupled with respect to the center tap 95, the output voltage at the load will be full-wave AD rectified. Other configurations of sets of parallel switches may also be used to perform full-wave rectification. For example, a bridge rectifier as shown in FIG. 7 avoids the need for a center-tapped transformer. Four sets of parallel switches 105, 106, 107, and 108 are arranged in the bridge configuration. Each set 105–108 is controlled by a controller 30 that performs synchronous rectification as discussed with respect to FIG. 5*b.* An AC current flows through the secondary winding of the transformer. Because of the bridge configuration, sets 105 and 107 conduct during positive half cycles of the AC current. Conversely, sets 106 and 108 conduct during negative half cycles of the AC current. In an alternate embodiment illustrated in FIG. 8, sets 107 and 108 may be replaced by diodes.

Specific examples of the present invention have been shown by way of example in the drawings and are herein described in detail. It is to be understood, however, that the invention is not to be limited to the particular forms or methods disclosed, but to the contrary, the invention is to broadly cover all modifications, equivalents, and alternatives encompassed by the scope of the appended claim.

I claim:

1. An AC to DC linear power regulator, comprising:

an input;

an output;

a plurality of switch elements connected in parallel between the input and output, each switch element comprising a pair of saturated, series-connected field effect transistors, wherein the series-connected field effect transistors in each pair are coupled source to source; and a controller for switching ON a subset of the plurality of switch elements, wherein the controller varies the size of the subset in response to sensing load demand at the output such that the controller regulates an output voltage.

2. The power regulator of claim 1, wherein each switch element comprises a transmission gate.

3. The power regulator of claim 1, wherein the controller switches ON the subset of switch elements in response to comparing the output voltage to a reference voltage.

4. The power regulator of claim 1, wherein the controller switches ON the subset of switch elements in response to comparing an output current to a reference current.

5. The power regulator of claim 1, wherein the controller further varies the size of the subset in response to anticipating a power demand at the output.

6. A method of providing linear AC to DC power regulation, comprising:

providing a plurality of switch elements coupled in parallel between an input and an output, each switch element comprising a pair of saturated, series-connected field effect transistors coupled source to source, wherein a subset of switches, when ON, define a resistance between the input and the output; and in response to sensing a load demand at the output; varying the resistance between the input and the output by varying the size of the subset of ON switches, whereby a voltage at the output is regulated.

7. The method of claim 6, further comprising:

applying an AC voltage at the input; and controlling the subset of ON switches to only be ON when the AC voltage input is greater than a positive output voltage, whereby synchronous rectification is achieved.

8. The method of claim 6, further comprising:

applying an AC voltage at the input; and controlling the subset of ON switches to only be ON when the AC voltage input is less than a negative output voltage, whereby synchronous rectification is achieved.

* * * * *